US006720725B2

(12) United States Patent
De Jong et al.

(10) Patent No.: US 6,720,725 B2
(45) Date of Patent: Apr. 13, 2004

(54) PICTURE DISPLAY DEVICE WITH REDUCED DEFLECTION POWER

(75) Inventors: Marteijn De Jong, Eindhoven (NL); Marcellinus Petrus Carolus Michael Krijn, Eindhoven (NL); Pim Theo Tuyls, Eindhoven (NL); Boris Skoric, Eindhoven (NL); Michel Cornelis Josephus Marie Vissenberg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 70 days.

(21) Appl. No.: 09/995,440

(22) Filed: Nov. 27, 2001

(65) Prior Publication Data

US 2002/0063508 A1 May 30, 2002

(30) Foreign Application Priority Data

Nov. 29, 2000 (EP) ..... 00204239

(51) Int. Cl.[7] ..... H01J 29/70

(52) U.S. Cl. ..... 313/440; 313/477 R; 313/364; 335/210

(58) Field of Search ..... 313/440, 477 R, 313/402, 403, 404, 405, 406, 407, 408, 364

(56) References Cited

U.S. PATENT DOCUMENTS

| | | | | | |
|---|---|---|---|---|---|
| 3,731,129 | A | * | 5/1973 | Tsuneta et al. | 313/408 |
| 5,763,995 | A | * | 6/1998 | Sano et al. | 313/477 R |
| 5,962,964 | A | * | 10/1999 | Sano et al. | 313/440 |
| 6,087,767 | A | * | 7/2000 | Sano et al. | 313/440 |
| 6,307,314 | B1 | * | 10/2001 | Sano | 313/440 |
| 6,465,944 | B1 | * | 10/2002 | New | 313/442 |

* cited by examiner

*Primary Examiner*—Edward J. Glick
*Assistant Examiner*—Elizabeth Gemmell

(57) ABSTRACT

A picture display device comprising a cathode ray tube (1) with an elongated display screen (8) and a deflection system (9) is described. The deflection power is reduced by two means. The deflection system (9) is arranged to scan the lines in the direction of the short axis (22) of the display screen (8), and the cone portion (3) of the cathode ray tube (1) has an elongated cross-section (54) whose aspect ratio is larger than or equal to the aspect ratio of the display screen (8), thereby enabling the deflection system (9), and in particular the line deflection subsystem (12), to be positioned closer to the electron beam envelope (51), which reduces magnetic losses.

14 Claims, 6 Drawing Sheets

AA section

AA section

PICTURE DISPLAY DEVICE WITH REDUCED DEFLECTION POWER

BACKGROUND OF THE INVENTION

The invention relates to a picture display device comprising:

a cathode ray tube having an elongated display screen with a long axis and a short axis, a cone portion whose cross-section has an elongated shape with a long axis and a short axis, a neck comprising means for generating at least one electron beam, and a deflection system mounted on said cone portion for generating electromagnetic fields for deflecting said electron beam(s).

A picture display device as described above is known from U.S. Pat. No. 5,962,964. The CRT of said known display device comprises a cone portion whose cross-section varies gradually from a circular shape at the neck end of the cone portion to a rectangular shape at the display screen end of the cone portion.

At the reference deflection plane—which is the plane perpendicular to the cathode ray tube axis and going through the point of intersection between the cathode ray tube axis and the asymptote to the trajectory of the electron beam when deflected to a corner of the display screen—the cone portion of said known display device has a cross-section which has a substantially rectangular shape. The deflection system can therefore be positioned closer to the envelope of the electron beam(s) than within CRTs whose cones have circular cross-sections. Magnetic losses are thereby reduced and, as a result, less deflection power is needed.

According to U.S. Pat. No. 5,962,964, deflection power consumption reductions between 17% and 25% can be achieved.

Nevertheless, there is a wish to further reduce the power consumption of the deflection system.

SUMMARY OF THE INVENTION

It is an object of the invention to provide a picture display device with which a further reduction of the deflection power is achieved.

In accordance with an aspect of the invention, the picture display device is therefore characterized in that the deflection system is arranged to scan the electron beam(s) along lines substantially parallel to the short axis of the display screen, and in that the part of the cone portion which is under the deflection system has at least one cross-section whose internal outline has a long axis/short axis ratio ($A_c$) which is larger than or equal to the long axis/short axis ratio ($A_{scr}$) of the display screen.

The present invention allows a further reduction of deflection power of about 30% as compared with the cited prior art. This reduction is essentially achieved by reducing the line deflection power, which is the major consumer in the deflection system.

The line deflection power is reduced by reducing the sweep amplitude, which is achieved by scanning the lines substantially parallel to the short axis of the display screen (called transposed scan) instead of parallel to the long axis of the display screen (called normal scan) and the line deflection power is further reduced by reducing magnetic losses, which is achieved by bringing the line deflection system closer to the electron beam envelope, while paying particular attention to the aspect ratio of the latter.

The inventors have realised that, with transposed scanning, the aspect ratio of the cross-section of the electron beam envelope ($A_{el}$) in parts of the region under the deflection system is larger than or equal to $A_{scr}$, in contrast to normal scanning.

Based on this insight, the picture display device in accordance with the invention comprises a cone portion whose cross-section in parts of the region under the deflection system has an aspect ratio ($A_c$) which is also larger than or equal to $A_{scr}$.

In preferred embodiments, $A_{el}$ exceeds $A_{scr}$ in parts of the region under the deflection system to the extent that $(A_{el}-1)/(A_{scr}-1) \geqq 1.1$, and therefore it is advantageous that $A_c$ also exceeds $A_{scr}$ to the extent that $(A_c-1)/(A_{scr}-1) \geqq 1.1$ in parts of that region.

In the region between the reference deflection plane and that end of the deflection system nearest to the display screen—which is the region where most of the magnetic field is concentrated—it is also advantageous that the cross-section of the cone has a shape which follows the shape of the electron beam envelope as closely as possible. Therefore, it is advantageous that, in this region, $A_c$ first increases, goes through a maximum and then decreases.

Furthermore, the reduction of deflection power grows with growing screen aspect ratios. The invention is thus particularly effective for picture display devices with large screen aspect ratios. In particular, the invention is advantageous for picture display devices with $A_{scr}>4/3$, and a fortiori for picture display devices with $A_{scr} \geqq 16/9$.

The economy of deflection power may be used advantageously to increase the maximum deflection angle of the electron beam(s). In preferred embodiments, maximum deflection angles larger than or equal to 120° are realised. This is useful in building slimmer CRTs.

BRIEF DESCRIPTION OF THE DRAWINGS

These and further aspects of the invention will be explained in greater detail by way of example and with reference to the accompanying drawings, in which.

The Figures are not drawn to scale. In general, like reference numerals refer to like parts.

DETAILED DESCRIPTION OF PREFERRED EMBODIMENTS

Figure 1:
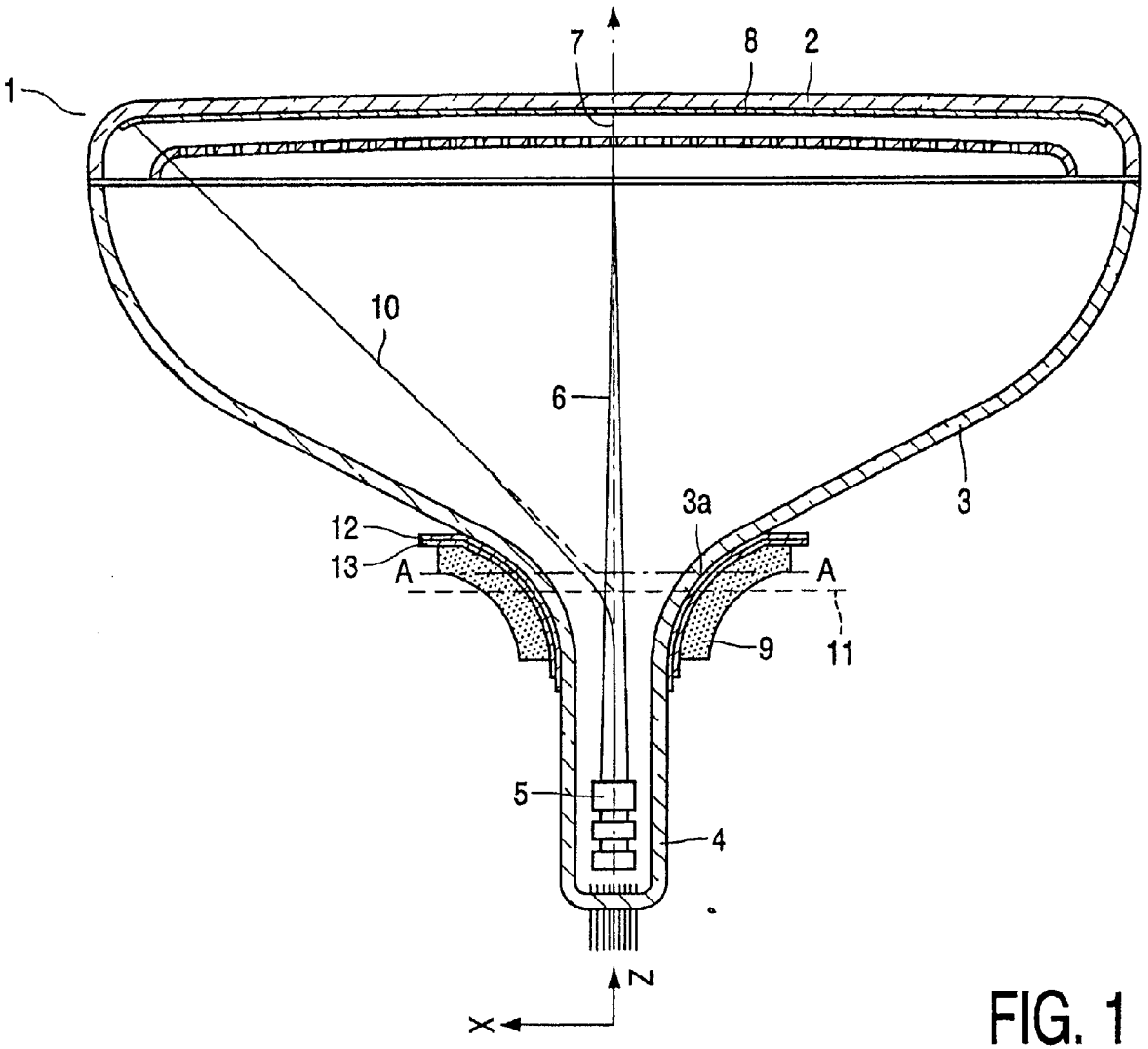
FIG. 1 is a sectional view of a picture display device according to an embodiment of the invention.

A picture display device according to a preferred embodiment of the invention is shown in FIG. 1.

It comprises a cathode ray tube (1), which includes a display window (2), a cone portion (3), and a neck (4). The neck (4) accommodates a means (5) for generating at least one electron beam (6). In this embodiment, three electron beams are generated in one plane (the in-line plane). The inner surface of the display window (2) comprises a large number of phosphor elements which form a display screen (8). When the electron beam (6) hits a phosphor element, the latter becomes phosphorescent, thereby creating a visible spot on the display screen (8). In the undeflected state, the electron beam (6) substantially coincides with the tube axis (7). On its way to the display screen (8), the electron beam (6) is deflected by means of a deflection system (9) covering a part (3*a*) of the cone portion (3). Said deflection system (9) comprises a line deflection subsystem (12) and a frame deflection subsystem (13), in order to create a two-dimensional picture on the display screen (8). In this embodiment, the deflection system (9) is made up of sets of coils, one set for the line deflection subsystem (12) and another set for the frame deflection subsystem (13).

FIG. 1 also shows the reference deflection plane (11) which is a plane perpendicular to the tube axis (7) and going through the point of intersection between the tube axis (7) and the asymptote to the trajectory (10) of the electron beam when deflected to a corner of the display screen (8).

Figure 2:
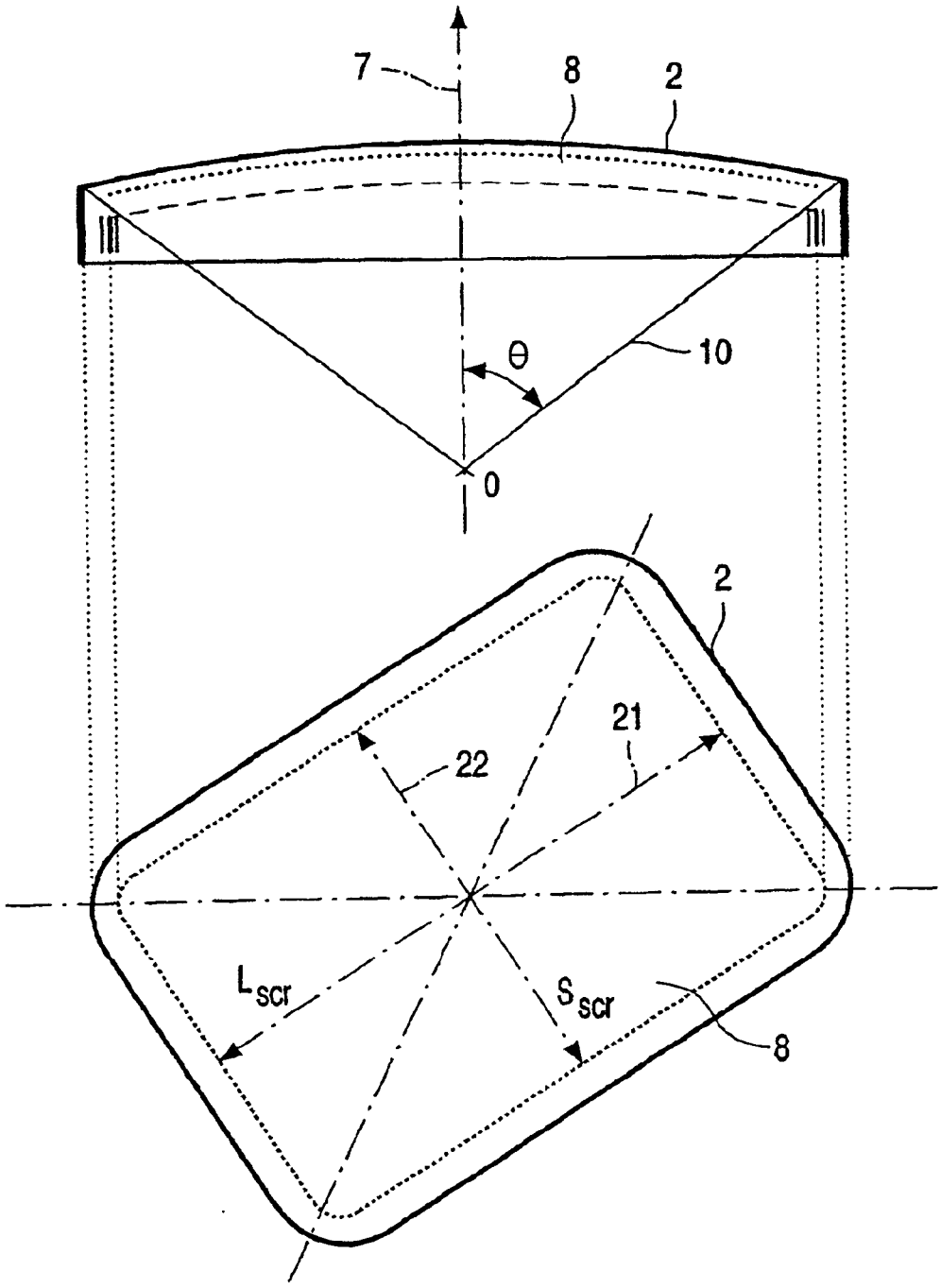
FIG. 2 is a sectional view of the display window.

As can be seen from FIG. 2, the display screen (8) has an elongated shape with two perpendicular axes of symmetry: a long axis (21) having a length of $L_{scr}$ and a short axis (22) having a length of $S_{scr}$. In order to quantify the amount of elongation of the display screen (8), the aspect ratio of the display screen (8) is defined as $A_{scr}=L_{scr}/S_{scr}$.

The maximum deflection angle is also defined as the angle θ between the tube axis (7) and the deflected electron beam (10) when the electron beam is deflected so as to hit a point on the display screen (8) which is furthest away from the intersection between the tube axis (7) and the display screen (8).

Figure 3A:
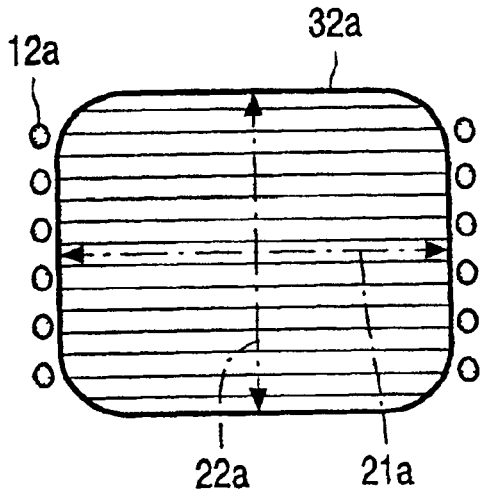
FIGS. 3*a* and 3*b* are schematic representations of a cross-section of a picture display device under the deflection system according to the prior art and according to an embodiment of the present invention, respectively, showing the principle of normal scanning versus transposed scanning.
Figure 3B:
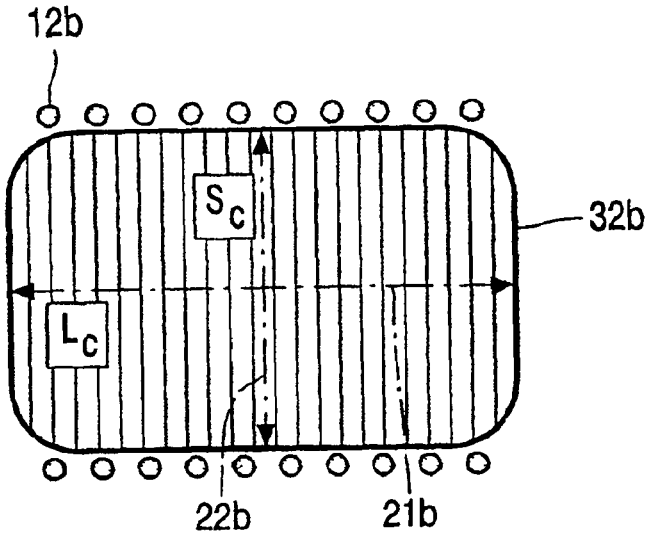

FIGS. 3*a* and 3*b* schematically show a cross-section of a picture display device in a region (3*a*) where the cone portion (3) is under the deflection system (9) according to the prior art (FIG. 3*a*) and according to an embodiment of the present invention (FIG. 3*b*), respectively. As can be seen in these Figures, a cross-section (32*a,b*) of the cone portion under the deflection system (9) has an elongated shape with two perpendicular axes of symmetry: a long axis (21*a,b*) having a length of $L_c$ and a short axis (22*a,b*) having a length of $S_c$. In order to quantify the amount of elongation of the cross-section of a cone portion, the aspect ratio of the cross-section of a cone portion is defined as $A_c=L_c/S_c$.

In the prior art (FIG. 3*a*), the line deflection subsystem (12*a*) deflects the electron beam (6) so as to scan the display screen (8) along lines substantially parallel to the long axis (21*a*) of the display screen (called normal scan).

According to the invention (FIG. 3*b*), the line deflection subsystem (12*b*) deflects the electron beam so as to scan the display screen (8) along lines substantially parallel to the short axis (22*b*) of the display screen (called transposed scan), and a cross-section (32*b*) of the cone portion under the deflection system (9) has an aspect ratio $A_c$ which is larger than the aspect ratio of the display screen ($A_{scr}$).

With transposed scan, the line deflection power can be reduced by virtue of the reduced sweep amplitude.

Figure 4A:
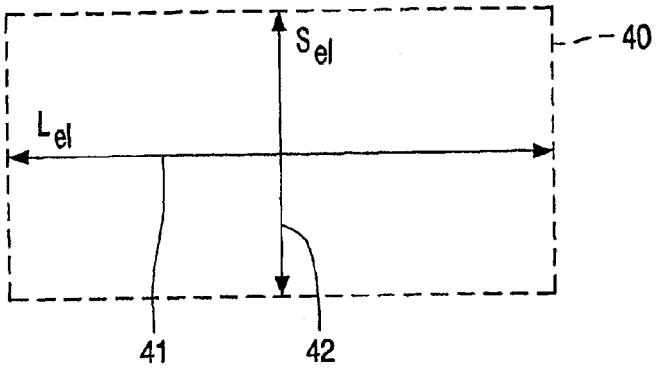
FIG. 4*a* is a cross-section of the electron beam envelope in the region under the deflection system.

The inventors have also realized that, with transposed scan, the electron beam envelope in part of the region under the deflection system (9) has a particular shape. As can be seen in FIG. 4*a*, a cross-section (40) of the electron beam envelope in said region has an elongated shape with a long axis (41) having a length of $L_{el}$ and a short axis (42) having a length of $S_{el}$. In order to quantify the amount of elongation, the aspect ratio of a cross-section of the electron beam envelope is defined as $A_{el}=L_{el}/S_{el}$.

Figure 4B:
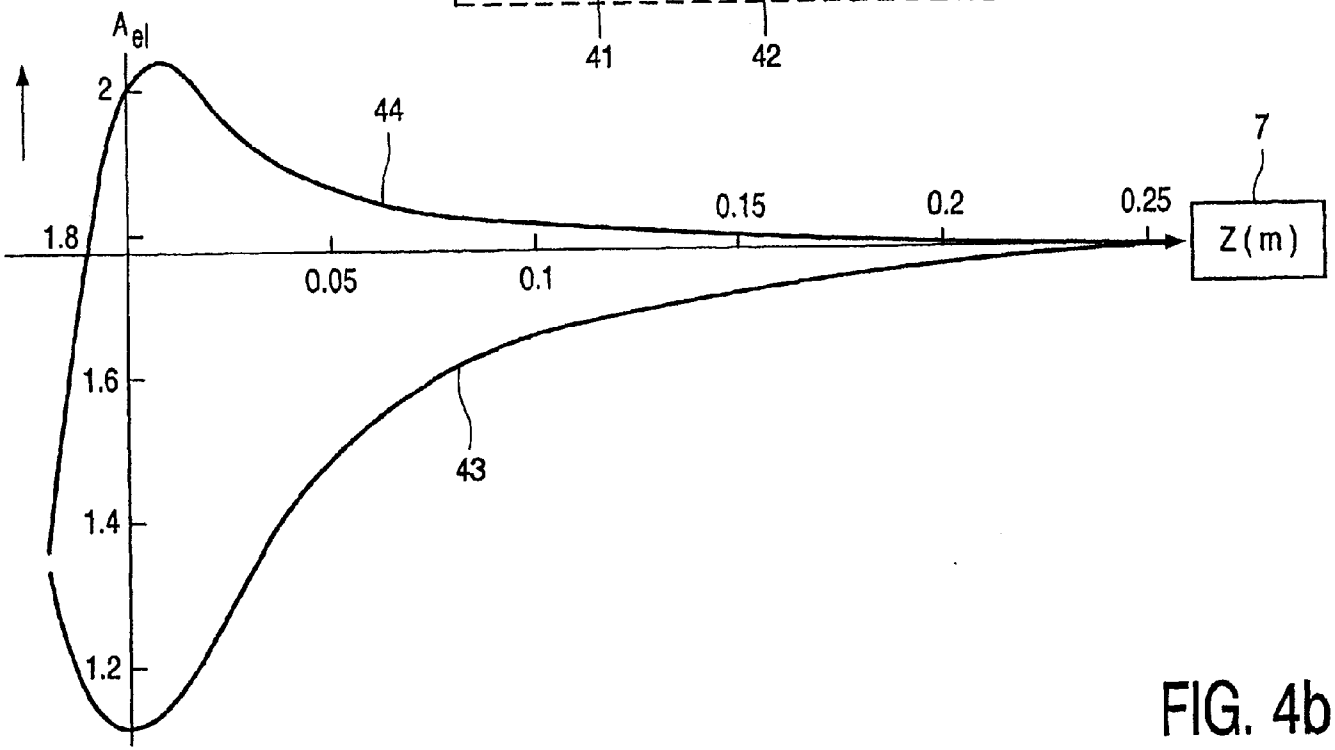
FIG. 4*b* is a graph showing the values of the aspect ratio of the electron beam envelope along the z-axis for a CRT with normal scanning and with transposed scanning.

FIG. 4*b* is a graph showing a curve with values of $A_{el}$ along the tube axis Z(7) for a display screen (8) with an aspect ratio $A_{scr}=16/9$, both for normal scan (curve 43) and for transposed scan (curve 44).

Figure 6:
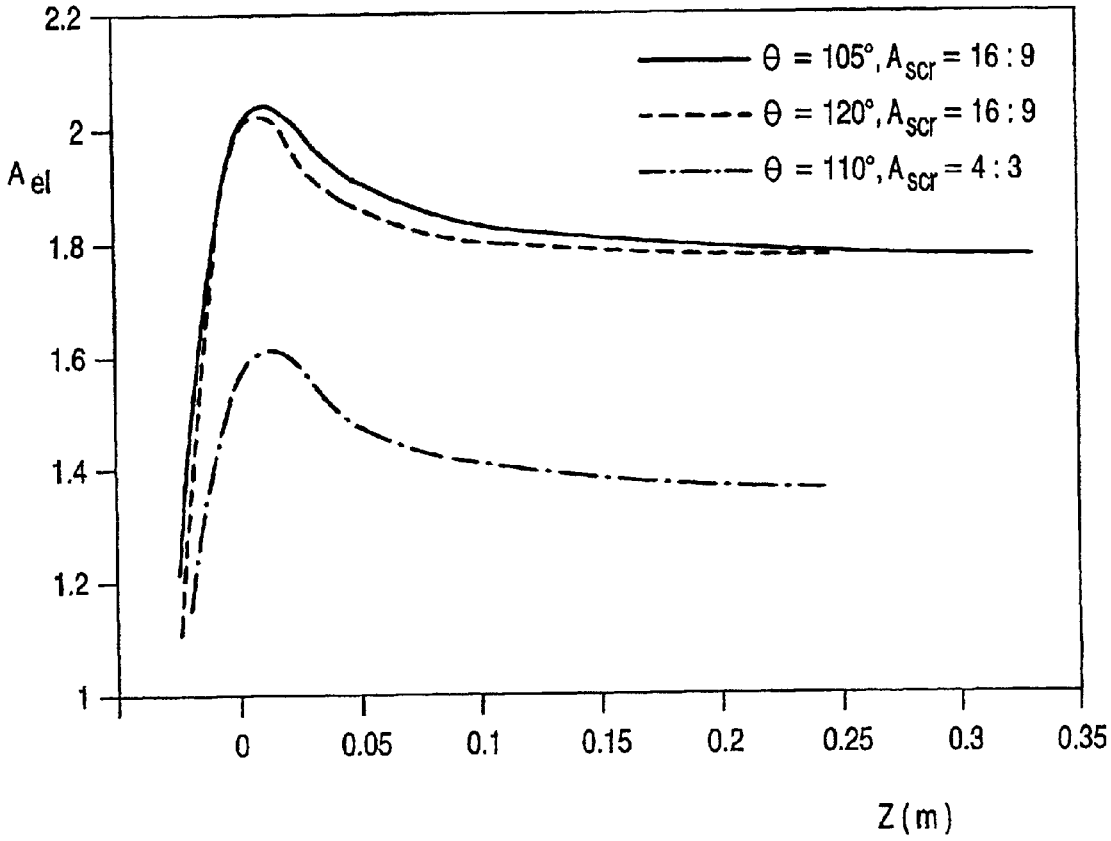
FIG. 6 is a graph showing the values of the aspect ratio of the electron beam envelope along the z-axis for a CRT with transposed scanning for various screen aspect ratios and for various maximum deflection angles.

In the region under the deflection system (z=−0.03 to z=+0.04), the value of $A_{el}$ for transposed scan grows quickly towards the value of $A_{scr}$, and even exceeds it, in contrast to normal scan. This characteristic feature holds for various screen aspect ratios (ex. 4/3 and 16/9) and for various maximum deflection angles (ex. 105°, 110° and 120°), as can be seen from FIG. 6.

Based on this insight, a picture display device according to the present invention comprises a cone portion in part of the region under the deflection system (9) whose cross-section has an aspect ratio ($A_c$) which is also larger than or equal to $A_{scr}$.

This allows bringing the deflection system (9), and in particular the line deflection subsystem (12), much closer to the electron beam envelope, thereby reducing magnetic losses and consequently reducing the deflection power.

Figure 5A:
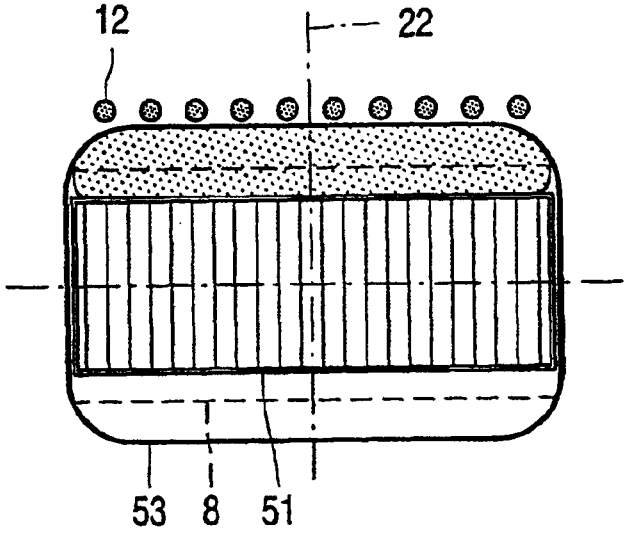
FIGS. 5*a* and 5*b* are schematic representations of a cross-section of a picture display device under the deflection system, showing the difference in cone aspect ratios.
Figure 5B:
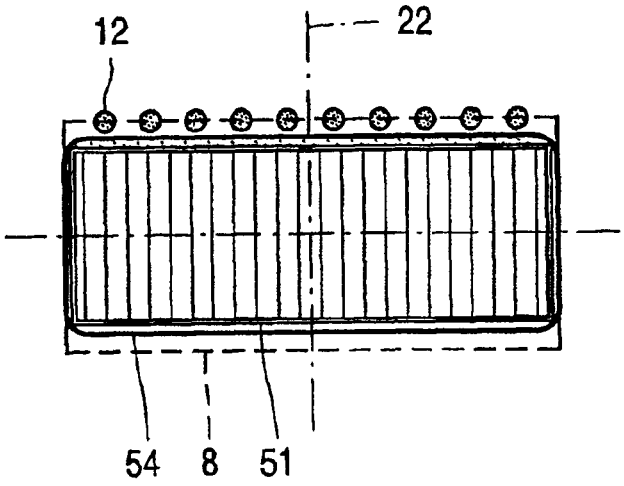

Such an effect is illustrated in FIG. 5*a* and FIG. 5*b*. Both Figures schematically show a cross-section of a picture display device in part of the region (3*a*) under the deflection system (9). FIG. 5*a* shows a cone cross-section (53) with an aspect ratio $A_c$ which is smaller than the aspect ratio $A_{scr}$ of the display screen (8), whereas FIG. 5*b* shows a cone cross-section (54) with an aspect ratio $A_c$ which is larger than the aspect ratio $A_{scr}$ of the display screen (8), thereby enabling the line deflection subsystem (12) to be positioned closer to the electron beam envelope (51).

The aspect ratio $A_c$ of known picture display devices varies gradually from 1 to $A_{scr}$, without ever getting equal to, or neither exceeding $A_{scr}$. Typical examples are given in U.S. Pat. No. 5,962,964 for a 4:3 screen ($A_{scr}=1.333$), wherein $A_c=1.2$ at the reference deflection plane (11).

In preferred embodiments according to the present invention, $A_{el}$ exceeds $A_{scr}$ to the extent that $(A_{el}-1)/(A_{scr}-1)\geqq 1.1$ in part of the region under the deflection system (9), and therefore it is advantageous that $A_c$ also exceeds $A_{scr}$ to the extent that $(A_c-1)/(A_{scr}-1)\geqq 1.1$ in that region.

It is also advantageous that, in the region between the reference deflection plane (11) and that end of the deflection system (9) nearest to the display screen (8)—which is the region where most of the magnetic field is concentrated—the cross-section of the cone has a shape which follows the shape of the electron beam envelope as closely as possible. Therefore, it is advantageous that, in this region, $A_c$ first increases, goes through a maximum and then decreases.

Moreover, the power reduction effect increases with growing screen aspect ratios, so that the present invention is particularly attractive for new type picture display devices with large screen aspect ratios such as $A_{scr}>4/3$, and a fortiori for $A_{scr}\geqq 16/9$.

Overall, a picture display device according to the present invention can reduce the deflection power by about 30% as compared with the prior art.

A further merit of the invention is that the reduction of deflection power can be used advantageously to increase the maximum deflection angle. The depth of the CRT can be reduced in this way, leading to slimmer picture display devices.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The mere fact that certain measures are recited in mutually different dependent claims does not indicate that a combination of these measures cannot be used to advantage.

What is claimed is:

1. A picture display device comprising a cathode ray tube having an elongated display screen with a long axis and a short axis, a cone portion whose cross-section has an elongated shape with a long axis and a short axis, a neck comprising means for generating at least one electron beam, and a deflection system mounted on said cone portion for generating electromagnetic fields for deflecting said electron beam(s) in a line direction that is substantially parallel with said short axis and in a frame direction that is substantially parallel with said long axis, wherein a part of the cone portion under the deflection system has at least one cross-section whose internal outline has a long axis/short axis ratio (Ac) which is larger than or equal to the long axis/short axis ratio (Ascr) of the display screen.

2. A picture display device as claimed in claim 1, wherein the part of the cone portion which is under the deflection system has at least one cross-section whose internal outline has a long axis/short axis ratio (Ac) which is larger than the long axis/short axis ratio (Ascr) of the display screen.

3. A picture display device as claimed in claim 2, wherein (Ac-1)/(Ascr-1)≧1.1.

4. A picture display device as claimed in claim 2, wherein said electron beam(s) are deflected within a beam envelope under the deflection system having a long axis/short axis ratio (Ael) which first increases, goes through a maximum and then decreases.

5. A picture display device as claimed in claim 1, wherein Ascr>4/3.

6. A picture display device as claimed in claim 5, wherein Ascr≧16/9.

7. A picture display device as claimed in claim 1, wherein the maximum deflection angle of the electron beam(s) is larger than or equal to 120°.

8. A display device comprising:

a cathode ray tube having a display screen with a long axis of length Lscr and a short axis of length Sscr, a cone portion, and a neck with means for generating an electron beam along a tube axis;

a deflection system on said cone portion for deflecting said electron beam in a line direction that is substantially parallel with said short axis and in a frame direction that is substantially parallel with said long axis;

wherein said electron beam is scanned in a beam envelope within a plane that passes through said deflection system and that is substantially perpendicular to said tube axis such that said beam envelope has a short length Sel and a long length Lel; and wherein length Lel:/Sel>Lscr/Sscr.

9. A display device as claimed in claim 8 wherein a part of the cone portion under the deflection system has a cross-section with a long axis/short axis ratio(Ac) that is greater than Ascr, where Ascr=Lscr/Sscr.

10. A display device as claimed in claim 9, wherein (Ac-1)/(Ascr-1) ≧1.1.

11. A display device as claimed in claim 8 wherein said electron beam is scanned to produce a plurality of beam envelopes such that Lel:/Sel increases, goes through a maximum, and then decreases.

12. A display device as claimed in claim 9 wherein Ascr>4/3.

13. A display device as claimed in claim 9 wherein Ascr≧16/9.

14. A display device as claimed in claim 8 wherein said electron beam has a maximum deflection angle that is greater than or equal to 120°.

* * * * *